US009936764B2

(12) United States Patent
Lo

(10) Patent No.: US 9,936,764 B2
(45) Date of Patent: Apr. 10, 2018

(54) SHOE WITH REPLACEABLE WATER-PROOF SOCK

(71) Applicant: Chih-Fang Lo, Taichung (TW)

(72) Inventor: Chih-Fang Lo, Taichung (TW)

( * ) Notice: Subject to any disclaimer, the term of this patent is extended or adjusted under 35 U.S.C. 154(b) by 84 days.

(21) Appl. No.: 15/191,503

(22) Filed: Jun. 23, 2016

(65) Prior Publication Data

US 2017/0367436 A1 Dec. 28, 2017

(51) Int. Cl.

| | |
|---|---|
| ***A43B 3/00*** | (2006.01) |
| ***A43B 7/12*** | (2006.01) |
| ***A43B 5/04*** | (2006.01) |
| ***A43B 3/02*** | (2006.01) |
| ***A43B 23/07*** | (2006.01) |

(52) U.S. Cl.

CPC ..... *A43B 7/12* (2013.01); *A43B 3/02* (2013.01); *A43B 5/0409* (2013.01); *A43B 23/07* (2013.01)

(58) Field of Classification Search

CPC ..... A43B 3/02; A43B 3/04; A43B 5/0405; A43B 5/0409; A43B 5/18; A43B 7/12; A43B 17/10; A43B 17/18; A43B 19/00; A43B 23/07; A41D 17/005

USPC ..... 36/2 R, 1.5, 10, 114

See application file for complete search history.

(56) References Cited

U.S. PATENT DOCUMENTS 4,169,324 A * 10/1979 Gibbs ..... A43B 17/18 2/239
4,187,619 A * 2/1980 Gibbs ..... A43B 17/18 2/240
4,538,368 A * 9/1985 Mugford ..... A43B 3/16 36/112
5,483,704 A * 1/1996 Filipiak ..... A41F 13/00 2/239
5,499,459 A * 3/1996 Tomaro ..... A43B 1/0045 36/10
7,051,459 B1 * 5/2006 Wigutow ..... A43B 23/06 36/10
9,392,836 B2 * 7/2016 Hatfield ..... A43B 3/24
2002/0092205 A1 * 7/2002 Hall ..... A43B 3/0031 36/117.1
2003/0115777 A1 * 6/2003 Hall ..... A43B 3/0031 36/117.6
2005/0011083 A1 * 1/2005 Kosted ..... A43B 1/0081 36/9 R
2007/0227037 A1 * 10/2007 Kao ..... A43B 3/106 36/10

(Continued)

FOREIGN PATENT DOCUMENTS

DE 3924240 A1 * 6/1990 ..... A43B 5/0405
DE 19904852 A1 * 8/2000 ..... A43B 19/00
GB 1092429 A * 11/1967 ..... A43B 3/02

*Primary Examiner* — Jameson Collier
(74) *Attorney, Agent, or Firm* — Rosenberg, Klein & Lee

(57) ABSTRACT

A shoe includes an outsole and a vamp, and a first opening is defined in the top of the shoe. A first connection portion is located along the periphery of the first opening. A water-proof sock is inserted into the first opening and has a second opening defined in the top thereof. A second connection portion is formed at the periphery of the second opening. The first connection portion is detachably connected to the second connection portion to secure the water-proof sock to the shoe. The water-proof sock can be removed from the shoe by separating the first connection portion from the second connection portion.

4 Claims, 6 Drawing Sheets

(56) References Cited

U.S. PATENT DOCUMENTS

2008/0052955 A1* 3/2008 Barrow ..... A43B 5/0405
36/2.6

* cited by examiner

SHOE WITH REPLACEABLE WATER-PROOF SOCK

BACKGROUND OF THE INVENTION

1. Fields of the Invention

The present invention relates to a shoe/boot, and more particularly, to a shoe/boot with a replaceable water-proof sock which is detachably inserted into the shoe/boot.

2. Descriptions of Related Art

The conventional shoes provide comfort and protection to the feet, and some shoes are made for specific purposes such as water-proof. The water-proof shoes have a water-proof later which includes nine billion orifices through which sweat is released but water drops outside of the shoe cannot penetrates through the orifices. Therefore, the shoes are water-proof and can be used during a wet weather days. The weather changes severely for the past years so that many shoes use the water-proof fabric to provide the shoes with water-proof feature. Nevertheless, the shoes eventually have folding crumples or small cracks, the water-proof feature fails at these portions of the shoes.

Besides, the water-proof shoes have higher prices which make most of the consumers not to purchase them. The water-proof layer is sandwiched between the surface layer and the lining layer, when the surface layer cracks or have crumples, water may enter into the shoes. Once the water-proof feature fails, the shoes have to be discarded even if the crumples or cracks are located at a small area.

The present invention intends to provide a shoe/boot with a replaceable water-proof sock to eliminate the shortcomings mentioned above.

SUMMARY OF THE INVENTION

The present invention relates to a shoe/boot and comprises a first opening defined in the top thereof, and a first connection portion is located along the periphery of the first opening. A water-proof sock is inserted into the first opening and has a second opening defined in the top thereof. A second connection portion is formed at the periphery of the second opening. The first connection portion is detachably connected to the second connection portion to secure the water-proof sock to the shoe/boot.

Preferably, the second connection portion is located along the inner periphery of the second opening. A first folding plate extends from the periphery of the first opening and is inserted into the second opening of the water-proof sock. The first connection portion is located at the inner periphery of the first folding plate which is folded into the second opening of the water-proof sock so that the first connection portion is detachably connected to the second connection portion.

Preferably, the shoe/boot includes an outsole and a vamp which is connected along the periphery of the outsole. The vamp has a tongue which has a second folding plate located corresponding to the first opening. The water-proof sock has an extension plate which is located corresponding to the tongue. A positioning portion is formed at the inside of the extension plate. The extension plate is located between the tongue and the second folding plate. An attaching portion is formed at the inside of the second folding plate. The second folding plate is folded to mount to a free end of the extension plate, and the positioning portion is connected to the attaching portion.

Preferably, the first connection portion and the second connection portion each are a hook-and-loop strip.

Preferably, the positioning portion and the attaching portion each are a hook-and-loop strip.

Preferably, a sponge plate is attached to the outside of the extension plate and located between the tongue and the extension plate to provide protection to the wearer's instep of his/her foot.

The primary object of the present invention is to provide a shoe/boot which has a replaceable water-proof sock which is replaceable so that the shoe/boot does not need to be discarded.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
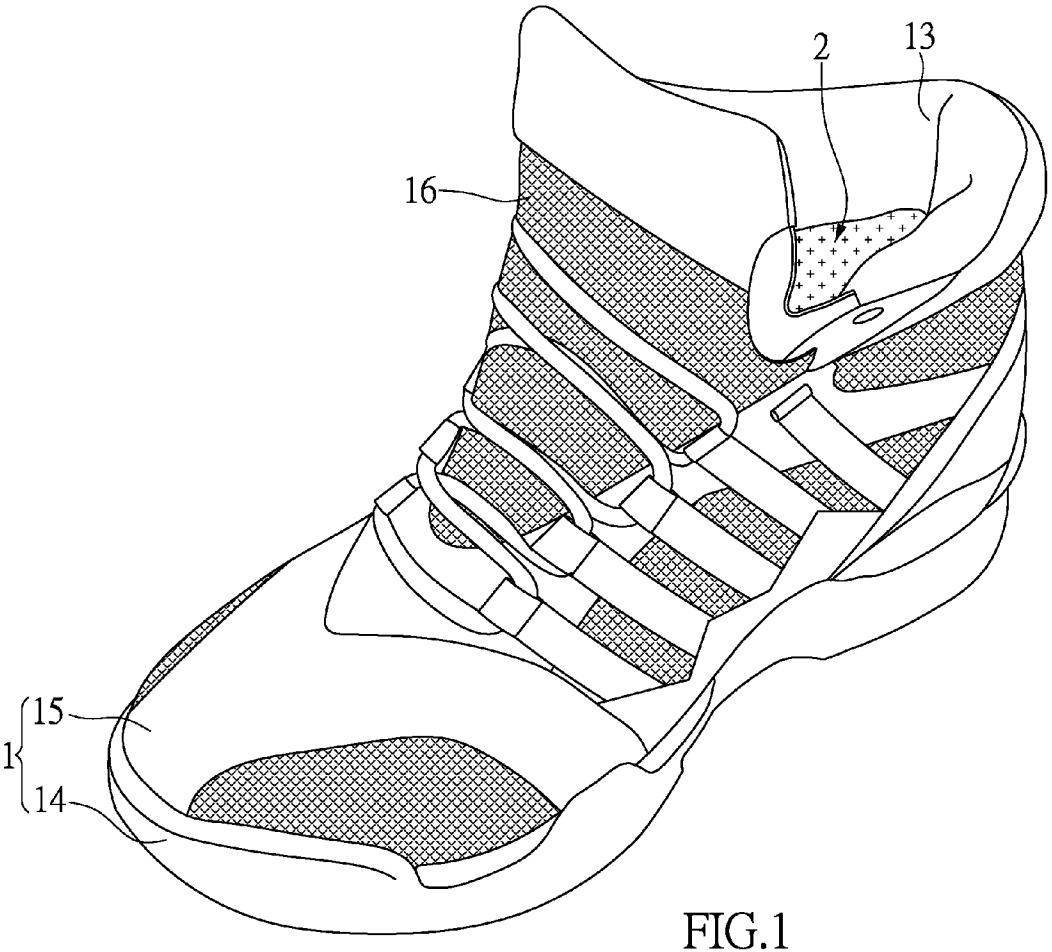
FIG. 1 is a perspective view to show the shoe/boot and the water-proof sock of the present invention.
Figure 2:
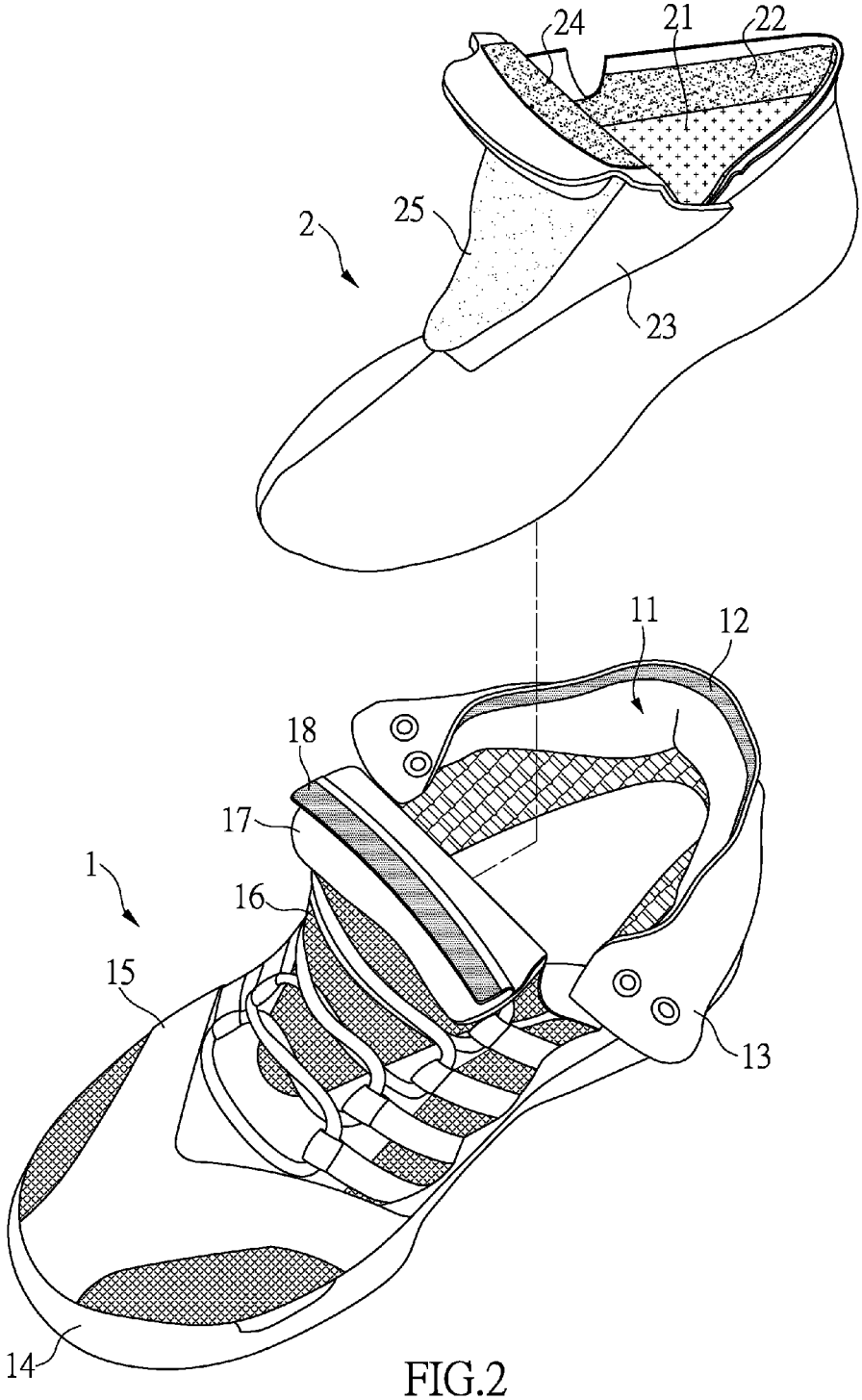
FIG. 2 is an exploded view of the shoe/boot and the water-proof sock of the present invention.
Figure 3:
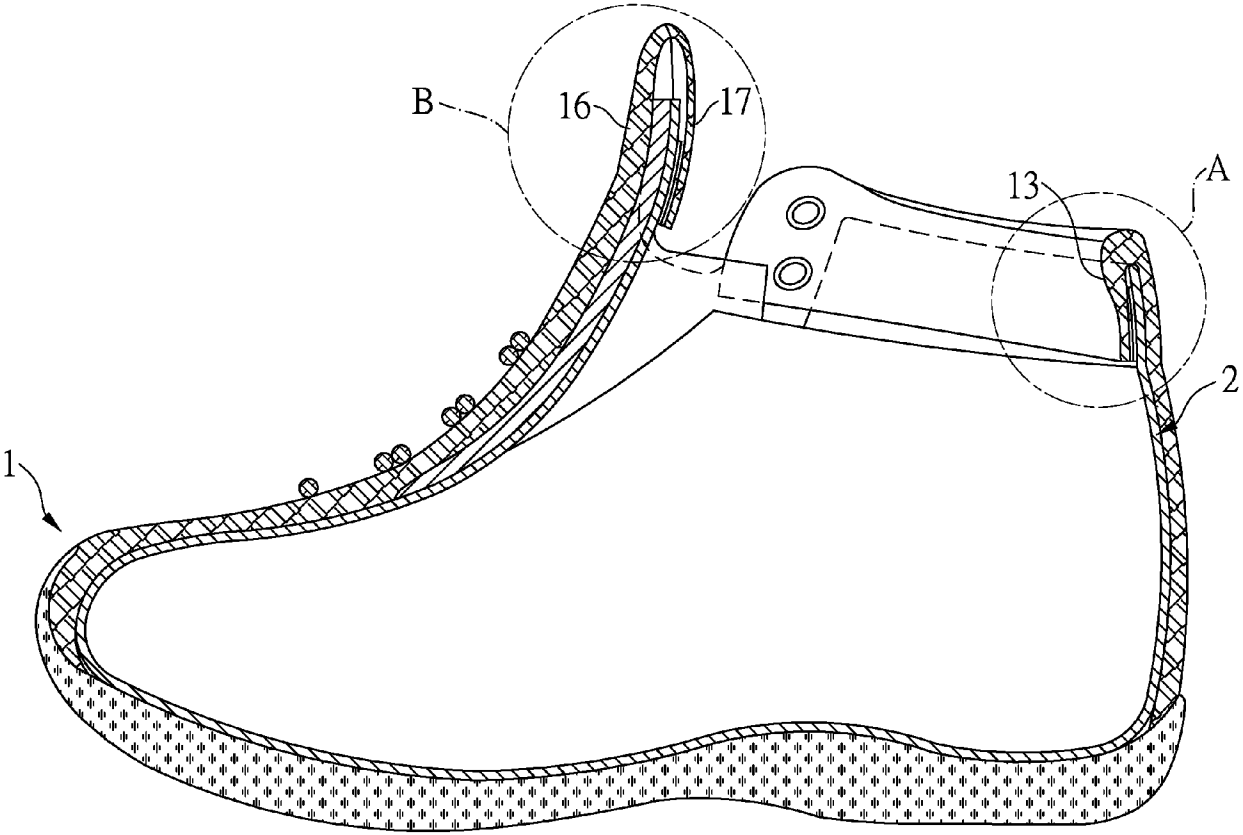
FIG. 3 is a cross sectional view of the shoe/boot and the water-proof sock of the present invention.
Figure 4:
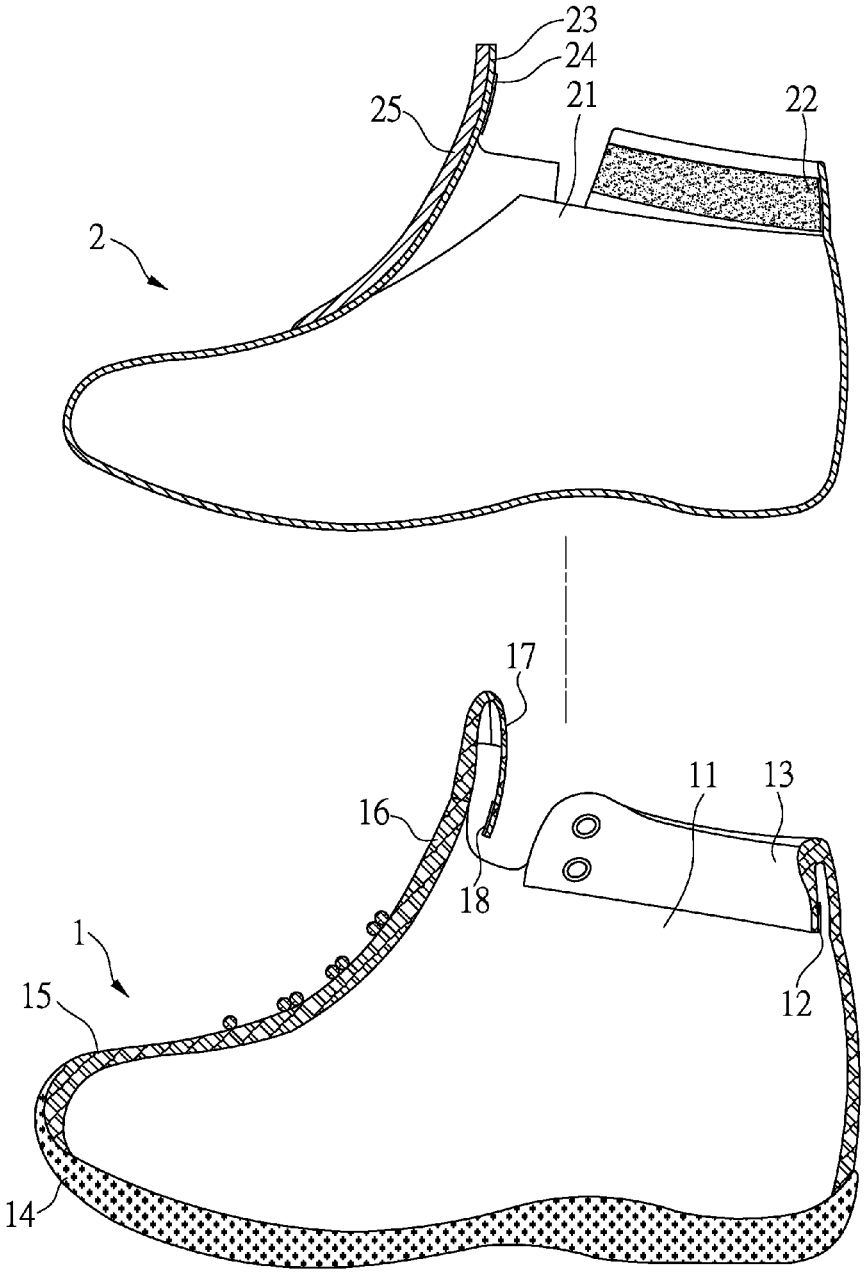
FIG. 4 shows the two respective cross sectional views of the shoe/boot and the water-proof sock of the present invention.

Referring to FIGS. 1 to 4, the shoe/boot 1 of the present invention comprises an outsole 14 and a vamp 15 which is connected along the periphery of the outsole 14. A first opening 11 is defined in the top of the vamp 15 and a first connection portion 12 is located along the periphery of the first opening 11. Specifically, a first folding plate 13 extends from the periphery of the first opening 11 and the first connection portion 12 is located at the inner periphery of the first folding plate 13. The vamp 15 has a tongue 16 which has a second folding plate 17 located corresponding to the first opening 11.

Figure 5:
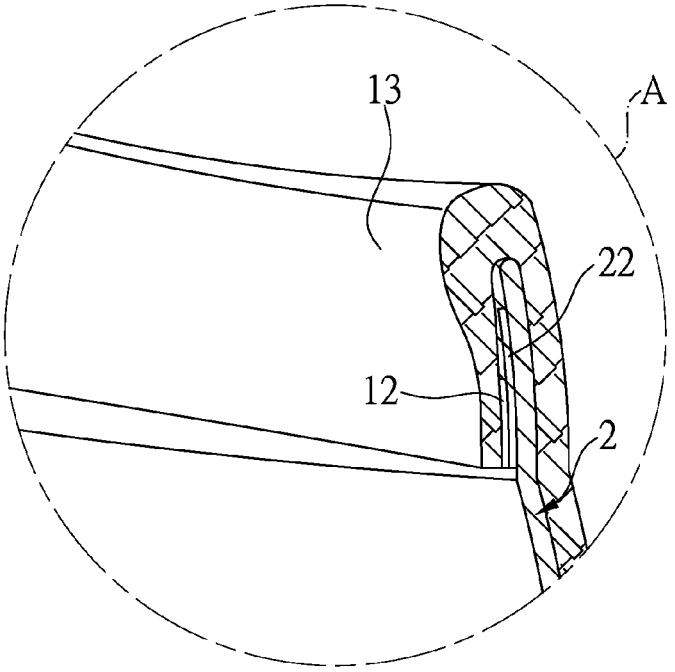
FIG. 5 is an enlarged view to show the circled "A" in FIG. 3.
Figure 6:
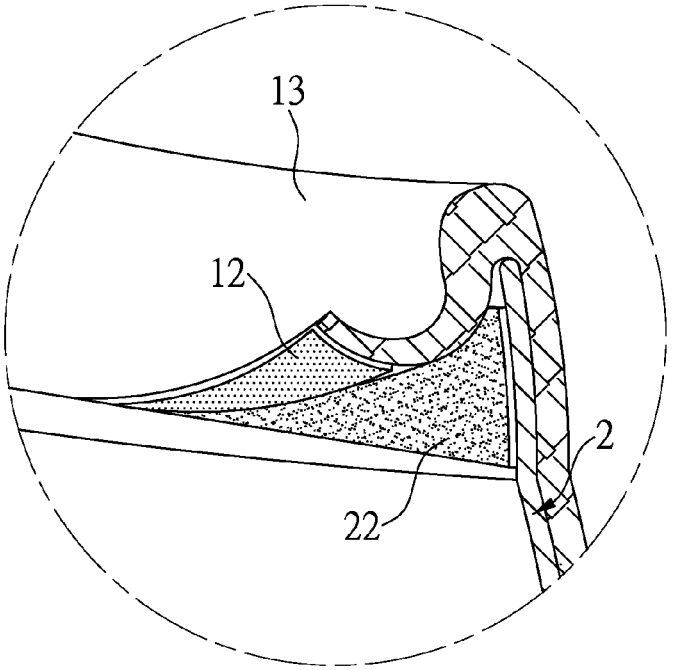
FIG. 6 shows that the first folding plate in FIG. 5 is to be attached to the second connection portion.

A water-proof sock 2 is inserted into the first opening 11 and has a second opening 21 defined in the top thereof. A second connection portion 22 is formed at the inner periphery of the second opening 21. The first folding plate 13 is inserted into the second opening 21 of the water-proof sock 2, so that the first connection portion 12 is detachably connected to the second connection portion 22, as shown in FIG. 5, to secure the water-proof sock 2 to the shoe/boot 1. When separating the first connection portion 12 from the second connection portion 22 as shown in FIG. 6, the water-proof sock 2 is able to be removed from the first opening 11.

Figure 7:
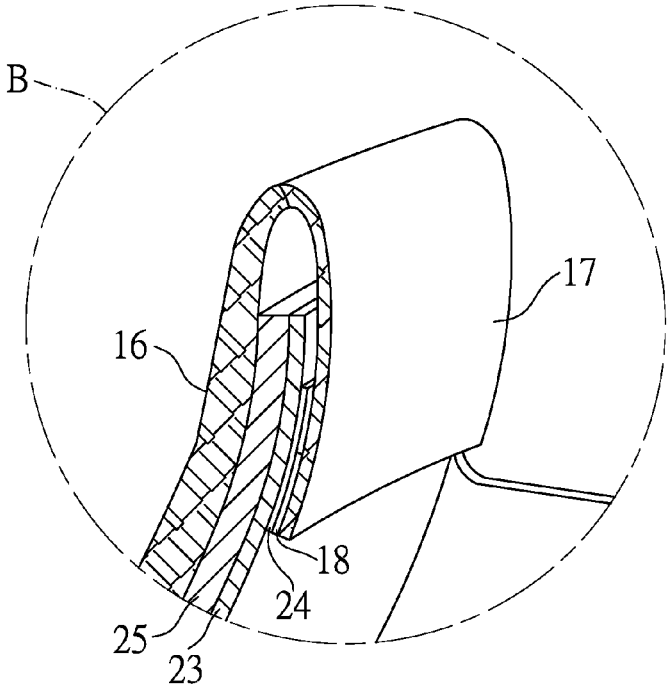
FIG. 7 is an enlarged view to show the circled "B" in FIG. 3.
Figure 8:
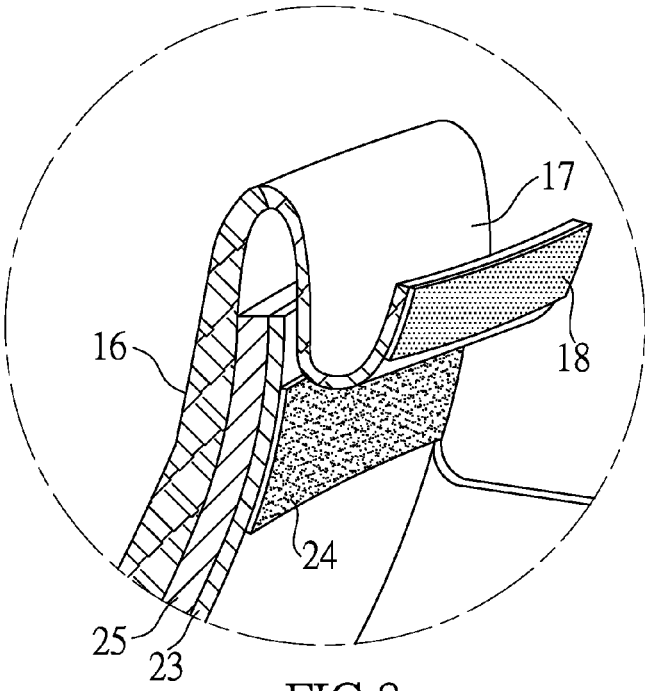
FIG. 8 shows that the second folding plate in FIG. 7 is to be attached to the positioning portion.

The water-proof sock 2 has an extension plate 23 which is located corresponding to the tongue 16, and a positioning portion 24 is formed at the inside of the extension plate 23. The extension plate 23 is located between the tongue 16 and the second folding plate 17 as shown in FIG. 7. An attaching portion 18 is formed at the inside of the second folding plate 17. The second folding plate 17 is folded to mount to the free end of the extension plate 23, and the positioning portion 24 is connected to the attaching portion 18 as shown in FIG. 8. The second folding plate 17 is securely connected to the free end of the extension plate 23 by the connection between the positioning portion 24 and the attaching portion 18. A sponge plate 25 is attached to the outside of the extension plate 23 and located between the tongue 16 and the extension plate 23 to provides protection to the instep of the foot that wears the shoe/boot 1.

The first connection portion 12 and the second connection portion 22 each are a hook-and-loop strip. Similarly, the positioning portion 24 and the attaching portion 18 each are a hook-and-loop strip.

The water-proof sock 2 is made of water-proof material and the water-proof sock 2 is an individual part from the shoe/boot 1, so that the consumers can purchase the water-proof socks 2 to be respectively used in the same shoe/boot 1. In other words, the water-proof socks 2 are replaceable.

The combination of the shoe/boot 1 and the water-proof socks 2 are less expensive when compared with the conventional water-proof shoes and boots.

The water-proof sock 2 is securely connected to the shoe/boot 1 by the connection between the first and second connection portions 12, 22, and between the attaching portion 18 and the positioning portion 24. Besides, the first and second folding plates 13, 17 are folded and are connected to the second connection portion 22 and the positioning portion 24, so that this folding arrangement further secures the water-proof sock 2 to the shoe/boot 1. Therefore, the water-proof sock 2 does not slip out from the shoe/boot 1 during use.

While we have shown and described the embodiment in accordance with the present invention, it should be clear to those skilled in the art that further embodiments may be made without departing from the scope of the present invention.

What is claimed is:

1. A shoe comprising:

a first opening defined in a top of the shoe and a first folding plate extending from an inner periphery of the first opening, a first connection portion located at an inner periphery of the first folding plate;

a water-proof sock inserted into the first opening and having a second opening defined in a top of the sock, a second connection portion formed at an inner periphery of the second opening, the first folding plate being folded into the second opening of the water-proof sock, the first connection portion being detachably connected to the second connection portion to secure the water-proof sock to the shoe; and a vamp connected along a periphery of an outsole, the vamp having a tongue which has a second folding plate located corresponding to the first opening, the water-proof sock having an extension plate which is located corresponding to the tongue, a positioning portion being formed at an inside of the extension plate, the extension plate located between the tongue and the second folding plate, an attaching portion being formed at an inside of the second folding plate, the second folding plate being folded to mount to a free end of the extension plate, and the positioning portion connected to the attaching portion.

2. The shoe as claimed in claim 1, wherein the first connection portion and the second connection portion each are complimentary components of a hook-and-loop strip.

3. The shoe as claimed in claim 1, wherein the positioning portion and the attaching portion each are complimentary components of a hook-and-loop strip.

4. The shoe as claimed in claim 1, wherein a sponge plate is attached to an outside of the extension plate and located between the tongue and the extension plate to provide protection to an instep of a foot.

* * * * *